US011731001B2

(12) United States Patent
Wu

(10) Patent No.: US 11,731,001 B2
(45) Date of Patent: Aug. 22, 2023

(54) ECCENTRIC COLUMN STRUCTURE OF WAIST TWISTING EXERCISE MACHINE

(71) Applicant: eMoMo Technology Co., Ltd., Shenzhen (CN)

(72) Inventor: Dong-Her Wu, Pu Yen Hsiang Chang Hua Hsien (TW)

(73) Assignee: eMoMo Technology Co., Ltd., Shenzhen (CN)

( * ) Notice: Subject to any disclaimer, the term of this patent is extended or adjusted under 35 U.S.C. 154(b) by 39 days.

(21) Appl. No.: 17/360,285

(22) Filed: Jun. 28, 2021

(65) Prior Publication Data

US 2022/0016472 A1 Jan. 20, 2022

(51) Int. Cl.
*A63B 21/00* (2006.01)
*A63B 22/14* (2006.01)
(Continued)

(52) U.S. Cl.
CPC ..... *A63B 21/4049* (2015.10); *A63B 22/14* (2013.01); *A63B 23/0205* (2013.01); *A63B 2023/003* (2013.01); *A63B 2208/0228* (2013.01)

(58) Field of Classification Search
CPC ..... A63B 21/4049; A63B 21/4031; A63B 22/14; A63B 22/18; A63B 23/0205;
(Continued)

(56) References Cited

U.S. PATENT DOCUMENTS 510,411 A 12/1893 Cunningham et al.
1,591,110 A 7/1926 Willson
(Continued)

FOREIGN PATENT DOCUMENTS

CN 304408831 12/2017
CN 306857160 9/2021
KR 301136410 11/2021

OTHER PUBLICATIONS amazon.com, aeris Swopper Air, available on Amazon.com, date first available Apr. 22, 2021, [site visited Jun. 13, 2022], URL: https://www.amazon.conn/dp/B0937GXVXS/ (Year: 2021).
amazon.com, CoVibrant Cushioned Rolling Stool, available on Amazon.com, date first available Apr. 22, 2021, [site visited Jun. 13, 2022], URL: https://www.amazon.conn/dp/B0936QCTW6/ (Year: 2021).
(Continued)

*Primary Examiner* — Garrett K Atkinson
*Assistant Examiner* — Kathleen M Fisk
(74) *Attorney, Agent, or Firm* — Womble Bond Dickinson (US) LLP

(57) ABSTRACT

An eccentric column structure of a waist twisting exercise machine is provided which includes a base, a cushion, and an eccentric column assembled between the base and the cushion. The cushion is supported above the base through the eccentric column, so that the seat height of the cushion is slightly higher than the height of knees of an average adult, thereby enabling riding in a relatively comfortable and ergonomic posture, and enabling exercising movements of rotating and waist twisting by using two feet landing on the ground as points of force application. In addition, the eccentric column is integrally formed by a bending processing of a metal pipe column, which not only avoids the formation of seams during assembly or structural weaknesses derived from welding, but also greatly enhances the overall strength of the structure, thereby being conducive to prolonging the service life and safety of the exercise machine.

19 Claims, 7 Drawing Sheets

(51) Int. Cl.
*A63B 23/02* (2006.01)
*A63B 23/00* (2006.01)

(58) Field of Classification Search
CPC ..... A63B 23/0482; A63B 23/02–0238; A63B 2023/003; A63B 2208/0228; A63B 2208/0233; A47C 1/04; A47C 3/18; A47C 9/002; A47C 7/004; A47C 1/06
See application file for complete search history.

(56) References Cited

U.S. PATENT DOCUMENTS

| | | | | |
|---|---|---|---|---|
| 2,494,094 | A | 1/1950 | Horstman | |
| D169,696 | S | 5/1953 | Bies | |
| 2,687,166 | A * | 8/1954 | Hamilton | A47C 3/18 248/410 |
| D204,391 | S | 4/1966 | Obayashi | |
| D206,118 | S | 11/1966 | Bates | |
| 3,312,437 | A | 4/1967 | Valerie | |
| D225,283 | S | 11/1972 | Axelrod | |
| D266,292 | S | 9/1982 | Leffler et al. | |
| 4,740,034 | A | 4/1988 | Snyder et al. | |
| 5,044,587 | A | 9/1991 | Degen | |
| D346,920 | S | 5/1994 | Vidal | |
| 5,893,604 | A | 4/1999 | Yao | |
| D436,270 | S | 1/2001 | Kane | |
| D458,765 | S | 6/2002 | Barbieri | |
| 7,775,944 | B1 * | 8/2010 | Shultz | A63B 22/18 601/87 |
| D668,464 | S | 10/2012 | Du | |
| D746,073 | S | 12/2015 | Elmaleh | |
| D748,924 | S | 2/2016 | Walser | |
| D782,855 | S | 4/2017 | Scagnellato et al. | |
| 9,675,841 | B2 * | 6/2017 | Wu | A63B 21/4033 |
| 9,707,449 | B2 * | 7/2017 | Wu | A63B 21/22 |
| D801,714 | S | 11/2017 | Elmaleh | |
| D808,193 | S | 1/2018 | Sun | |
| D823,624 | S | 7/2018 | Elmaleh | |
| D910,324 | S | 2/2021 | Tao | |
| 11,470,971 | B2 | 10/2022 | Saad et al. | |
| 2008/0191525 | A1 | 8/2008 | Jensen et al. | |
| 2016/0088944 | A1 | 3/2016 | Walser | |
| 2017/0050068 | A1 | 2/2017 | Wu | |
| 2017/0066121 | A1 | 3/2017 | Huang | |
| 2017/0113097 | A1 | 4/2017 | Wu | |
| 2017/0290432 | A1 | 10/2017 | Reinhard | |
| 2018/0236293 | A1 | 8/2018 | Chiu | |
| 2018/0279792 | A1 | 10/2018 | Casilio | |

OTHER PUBLICATIONS amazon.com, Flash Furniture Black Ergonomic Stool, available on Amazon.com, date first available Feb. 13, 2007, [site visited Jun. 13, 2022], URL:https://www.amazon.com/Flash-Fumiture-Black-Ergonomic-Stool/dp/B00TMK0NQ (Year: 2007).
amazon.com, Fully Luna Task Stool, available on Amazon.conn, date first available Sep. 20, 2021, [site visited Jun. 13, 2022], URL: https://www.amazon.com/dp/B09GPW4RVJ/(Year: 2021).
amazon.com, Perch Pneumatic Stool, available on Amazon.com, date first available Nov. 1, 2014, [site visited Jun. 13, 2022], URL: https://www.amazon.conn/Perch-Pneumatic-Adjustment-Hardwood-Workbench/dp/B0038AAOLS (Year: 2014).
amazon.com, Safco Products Twixt Active Seating, available on Amazon.com, oldest customer review Sep. 24, 2016, [site visited Jun. 13, 2022], URL:https://www.amazon.com/Safco-Products-300BL-Active-Seating/dp/B01HYMPNHQ/ (Year 2016).
amazon.com, Upaloop Fitness Seat, available on Amazon.com, date first available Apr. 15, 2021, [site visited Jun. 13, 2022], URL: https://www.amazon.conn/Upaloop-Fitness-Stability-Balance-Wellness/dp/B092172NFZ/ (Year: 2021).
amazon.com, Vivo Sit Stand Perch Stool, available on Amazon.com, date first available Aug. 24, 2020, [site visited Jun. 13, 2022], URL: https://www.amazon.conn/dp/B08GL1B7MQ/ (Year: 2022).
back app.com, Back App Smart Ergonomic Chair, available on backapp.com, Wayback Machine date Oct. 21, 2020, [site visited Jun. 13, 2022], URL:https://web.archive.org/web/20201021183914/https://www.backapp.com/en/products/backapp-smart/ (Year: 2020).
United States Patent and Trademark Office; Non-Final Office Action for U.S. Appl. No. 29/768,947; dated Jun. 22, 2022; 7 pages.
basspro.com, Bass Pro Shops Offset Seat Post, Aug. 11, 2020, 1 pg, https://www.basspro.com/shop/en/bass-pro-shops-offset-seat-post?hvarAID=shopping_googleproductextensions&ds_e=GOOGLE&ds_c=BPS%7CShopping%7CSmart%7CProprietary%7CGeneral%7CNAud%7CNVol%7CNMT&gclid=EAlalQobChMlwMGV36PR_AIVPg2tBh1-4A7XEAQYASABEgLmc_D_BwE&gclsrc=aw.ds.
United States Patent and Trademark Office; Notice of Allowance for U.S. Appl. No. 29/768,947; dated Dec. 1, 2022; 5 pages.

* cited by examiner

ECCENTRIC COLUMN STRUCTURE OF WAIST TWISTING EXERCISE MACHINE

CROSS-REFERENCE TO RELATED APPLICATIONS

This application claims priority to TW Application No. 109209023 filed Jul. 15, 2020, which is incorporated herein by reference in its entirety.

FIELD OF THE DISCLOSURE

The present disclosure relates generally to exercise machines, and more specifically to an eccentric column structure of a waist twisting exercise machine.

BACKGROUND OF THE DISCLOSURE

According to a well-known waist twisting exercise machine, as shown in FIG. 7, the typical waist twisting exercise machine 40 is provided with a base 41, with the bottom face of the base 41 being supported on the ground by four short bars 411. Above the center of the top face of the base is a cushion 43 that is pivoted by means of a crank 42. The cushion 43 provides a seat for a user. The crank 42 is of an inclined pipe shape, one end of the crank extends vertically and is fixedly provided with a shaft column 421. The other end of the crank 42 is provided with a vertical pipe 422 connected to the crank 42 by welding. The base 41 is provided with a pipe column 412 for accepting the shaft column 421 of the crank 42 and enabling rotation thereof. The bottom of the cushion 43 is provided with a plugging column 431 adapted to be accepted by the vertical pipe 422 of the crank 42, thereby connecting the base 41 and the cushion 43 through the crank 42 and enabling the cushion 43 to rotate and twist on the crank 42, to move with respect to the waist and abdomen of the user.

It would be apparent to those skilled in the art that the prior art structure described above has many disadvantages, as follows: the two ends of the crank 42 of the above-mentioned well-known structure are provided with the shaft column 421 and the vertical pipe 422 respectively in a welding or other assembling manner, which increases the processing steps and cost of the crank 42. Moreover, weak points of strength of the crank 42 are formed at the welds of the shaft column 421 and the vertical pipe 422 with the crank 42, which dramatically reduces the supporting capacity of the crank 42, making the waist twisting exercise machine prone to breakage or deformation at seams of the crank 42 under the action of waist twisting exercising. Thus, the structure lacks stability in use and may become unsafe. In view of this, from many years of experience in manufacturing, development and design of related products, the inventors have developed the disclosed waist twisting exercise machine with the aim of overcoming the shortcomings of the prior art noted above.

BRIEF DESCRIPTION OF THE EXEMPLARY EMBODIMENTS

The technical problem to be solved by the disclosure is to provide an eccentric column structure of a waist twisting exercise machine which overcomes the above-mentioned defects in the prior art.

The above-mentioned eccentric column structure of a waist twisting exercise machine includes a base, a cushion, and an eccentric column assembled between the base and the cushion. The eccentric column is integrally formed with two straight bar portions and a bending portion, the two straight bar portions are connected through the bending portion but are not located on a common axis. The end portions of the two straight bar portions are each narrowed in pipe diameter and provided with an assembling section. The eccentric column is combined with the base and the cushion by using the assembling sections. The cushion generates an eccentric rotating effect above the base through the eccentric column.

The base is provided with a combination hole for accepting one end of the eccentric column. At least one bearing member is disposed inside the combination hole. The base is fixedly provided with a first protecting cover facing the combination hole, and the first protecting cover is provided with a shaft passing hole. The bottom of the cushion is provided with a binding hole for accepting the other end of the eccentric column. At least one bearing member is disposed inside the binding hole. The cushion is fixedly provided with a second protecting cover facing the binding hole, and the second protecting cover is provided with a shaft passing hole.

According to an aspect, the combination hole of the base is located at the center of the base. According to another aspect, two bearing members are disposed inside the combination hole. One of the straight bar portions of the eccentric column passes through the shaft passing hole of the first protecting cover, and is connected to the bearing members inside the combination hole through the assembling section at the end portion. The bearing members and the assembling section are protected by the first protecting cover.

According to an aspect, two bearing members are disposed inside the binding hole of the cushion. The other of the straight bar portions of the eccentric column passes through the shaft passing hole of the second protecting cover, and is connected to the bearing members inside the binding hole through the assembling section at the end portion. The bearing members and the assembling section are protected by the second protecting cover.

In an aspect, the disclosure relates to an eccentric column structure of a waist twisting exercise machine. The eccentric column structure may include a base, a cushion, and an eccentric column assembled between the base and the cushion. The eccentric column may be integrally formed with a first straight bar portion, a second straight bar portion, and a bending portion. The first straight bar portion and the second straight bar portion may be connected through the bending portion but not located on a common axis. The first straight bar portion may also include a first end portion and the second straight bar portion may also include a second end portion, wherein each of the first end portion and the second end portion are in a spaced apart relationship from the bending portion, narrowed in pipe diameter, and provided respectively with a first assembling section and a second assembling section. The eccentric column may be connected to the base and the cushion by the first assembling section and the second assembling section. The cushion may be configured to eccentrically rotate above the base, through the eccentric column.

A waist twisting exercise machine according to the exemplary embodiments has the following effects compared with the prior art: the cushion for the waist twisting exercise machine according to the disclosure is supported by the eccentric column, so that the seat height is slightly higher than the height of knees of an average adult, thereby enabling riding in a relatively comfortable and ergonomic posture, and enabling performing exercising movements of rotating and waist twisting by using two feet landing on the ground at points of force application. In addition, the eccentric column is integrally formed by bending processing of a metal pipe column, which not only avoids the formation of seams from assembly or structural weaknesses derived from welding, but also greatly enhances the overall strength of the structure, thereby being conducive to prolonging the service life and safety of the waist twisting exercise machine.

BRIEF DESCRIPTION OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which.

Figure 1:
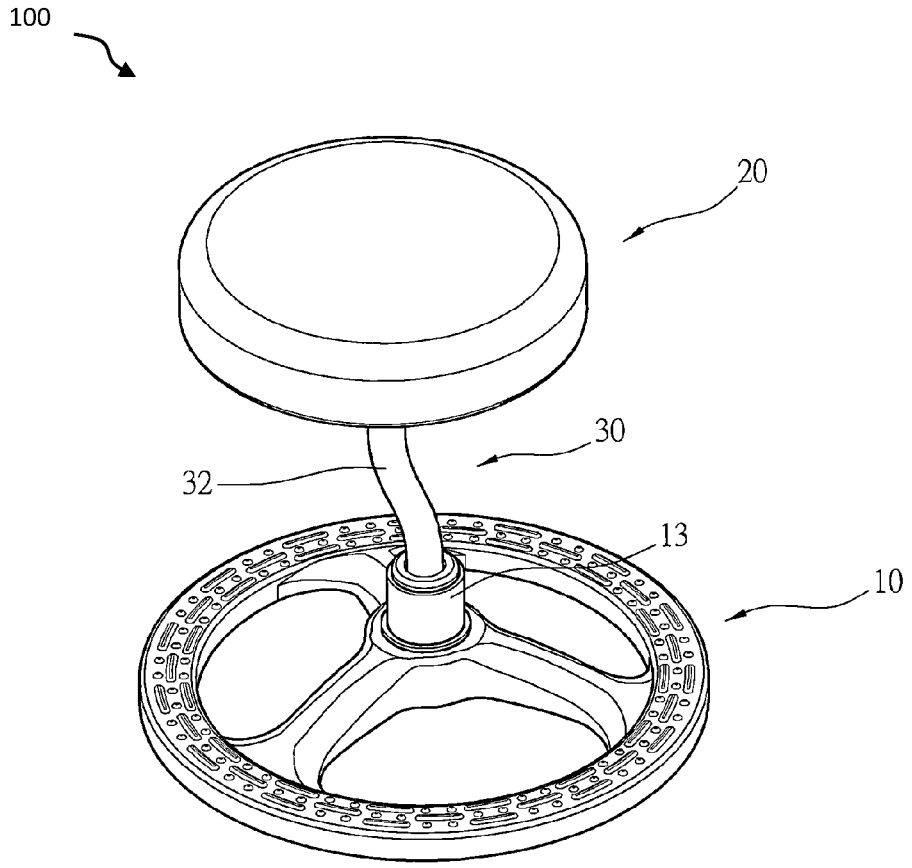
FIG. 1 shows a three-dimensional view of a waist twisting exercise machine, according to an examplary embodiment.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to emphasize specific features relevant to some embodiments.

The headings used herein are for organizational purposes only and are not meant to limit the scope of the disclosure or the claims. To facilitate understanding, reference numerals have been used, where possible, to designate like elements common to the figures.

DETAILED DESCRIPTION

Reference will now be made in detail to various exemplary embodiments. Each example is provided by way of explanation and is not meant as a limitation and does not constitute a definition of all possible embodiments.

Figure 2:
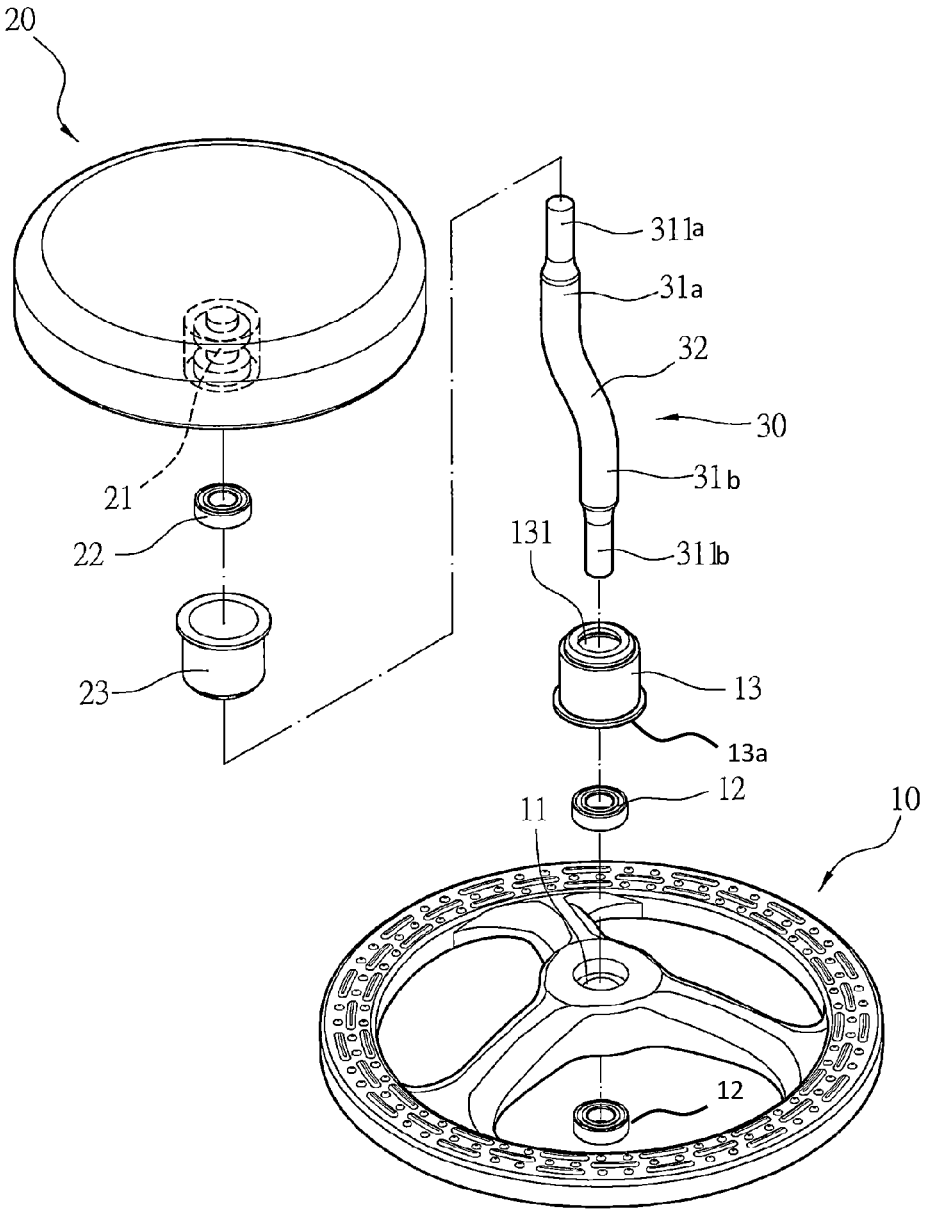
FIG. 2 shows an exploded view of the exemplary embodiment shown in FIG. 1.
Figure 3:
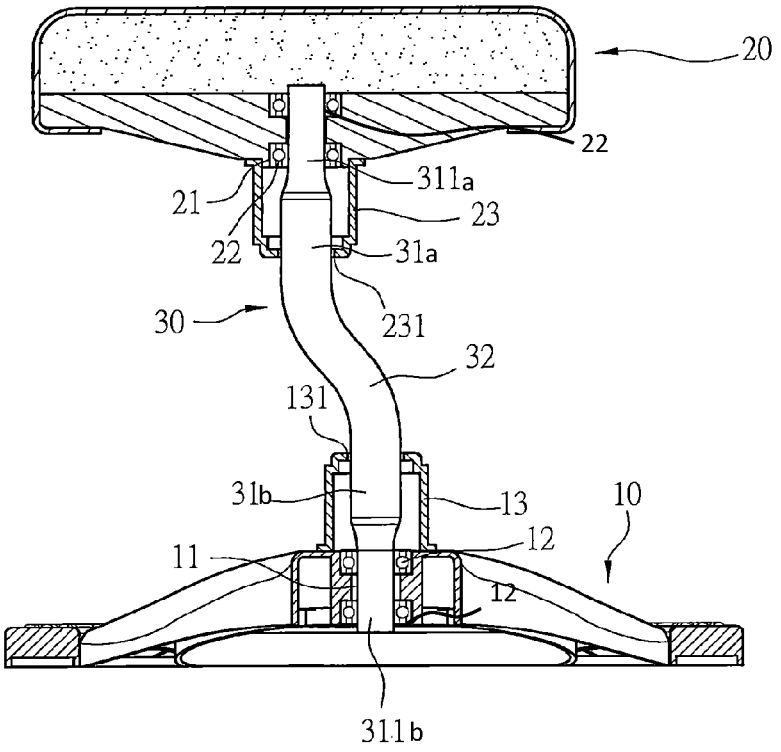
FIG. 3 shows a cross-sectional view of the exemplary embodiment shown in FIG. 1.
Figure 4:
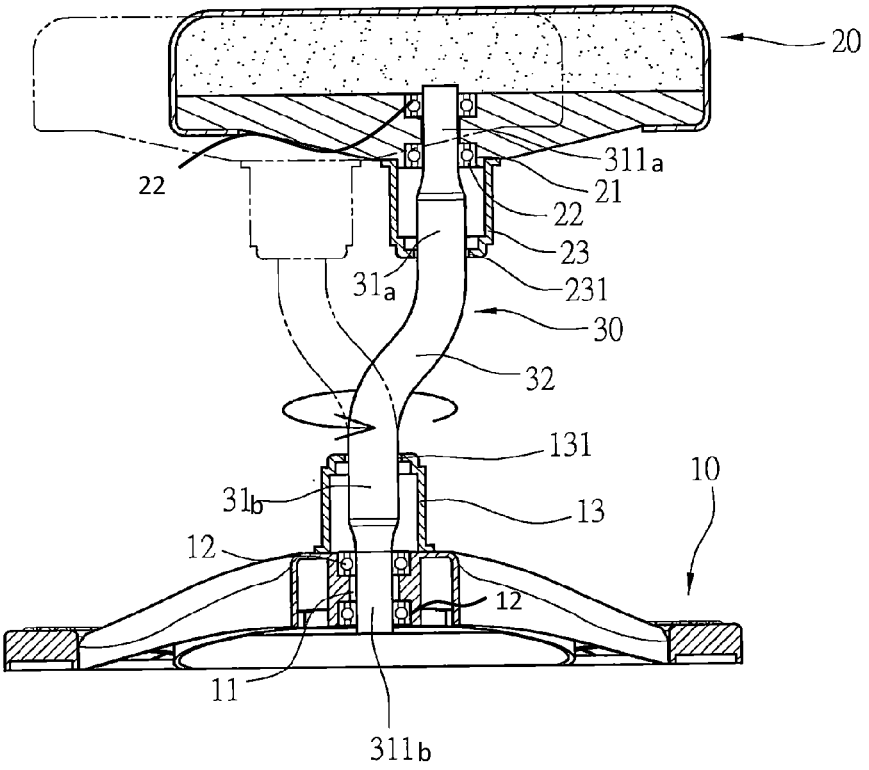
FIG. 4 is a schematic diagram of the action of rotating the exemplary embodiment shown in FIG. 1.
Figure 5:
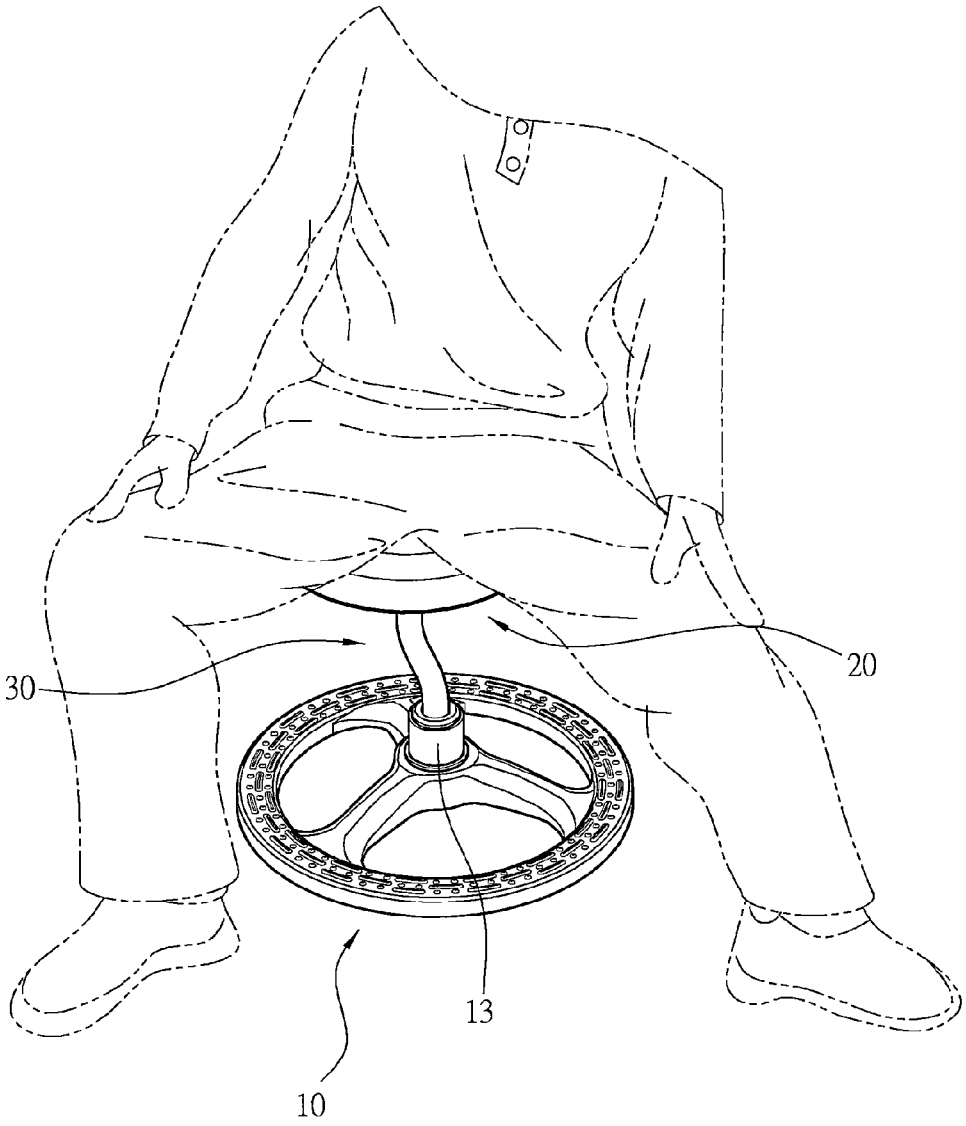
FIG. 5 is a schematic diagram showing a user riding the exemplary embodiment shown in FIG. 1, and twisting at the waist to swing in one direction.
Figure 6:
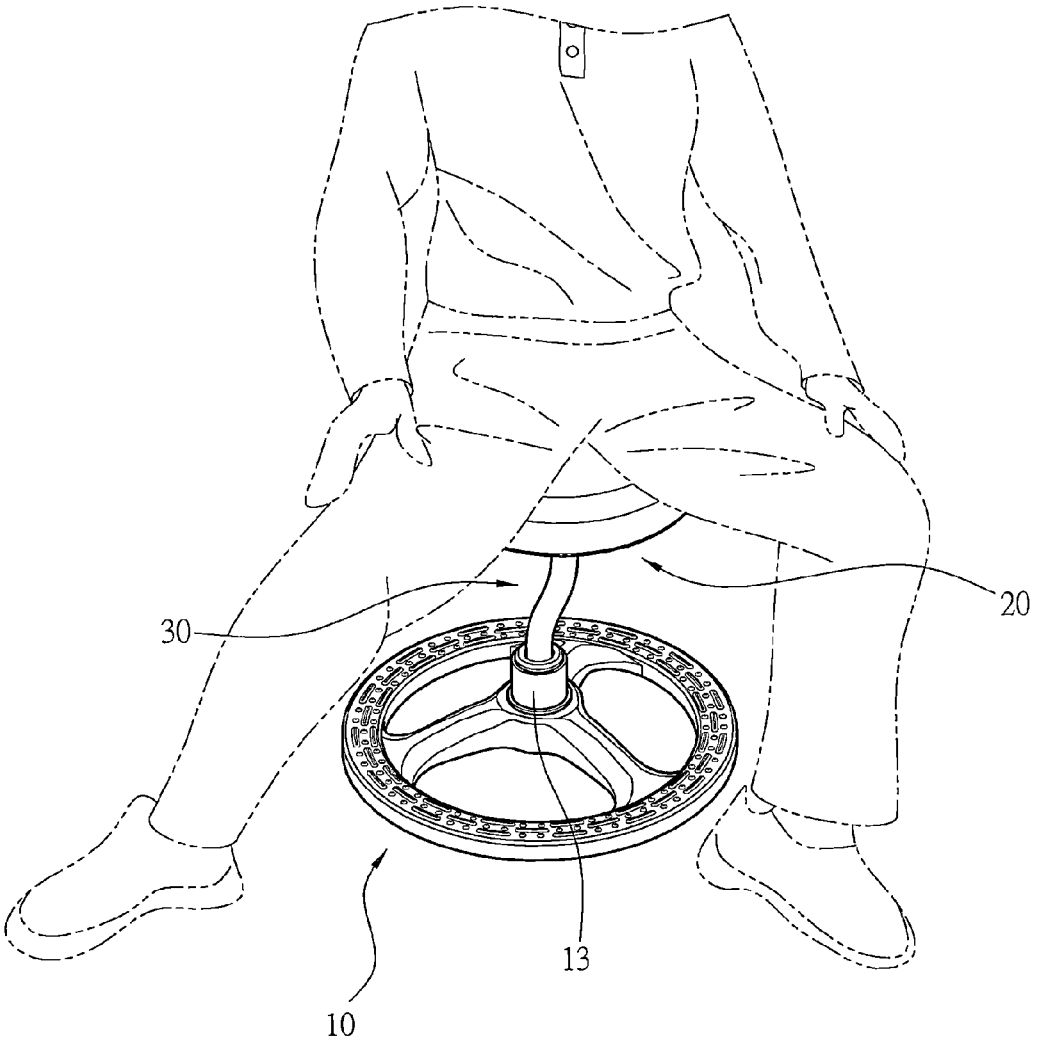
FIG. 6 is a further schematic diagram showing a user riding the exemplary embodiment shown in FIG. 1, and twisting at the waist to swing in an opposite direction than shown in FIG. 5.

FIGS. 1, 2 and 3 show an exemplary eccentric column structure 100 of a waist twisting exercise machine according to the disclosure. The exemplary eccentric column structure 100 includes a base 10, a cushion 20, and an eccentric column 30 assembled between the base 10 and the cushion 20. A combination hole 11 is disposed at the center of the base 10 for accepting one end of the eccentric column 30. Two bearing members 12, i.e., base bearing members 12, are positioned inside the combination hole 11. The base 10 is fixedly provided with a first protecting cover 13 secured thereto and facing the combination hole 11. In other words, the first protecting cover 13 includes an open end 13*a* that opens to the combination hole 11 to which the first protecting cover 13 is secured, at the open end 13*a*. The first protecting cover 13 is provided with a shaft passing hole 131, and a hole diameter of the shaft passing hole 131 is larger than a hole diameter of the combination hole 11. A binding hole 21 is disposed at the bottom of the cushion 20 for accepting the other end of the eccentric column 30. Two bearing members 22, i.e., cushion bearing members 22, are embedded inside the binding hole 21. The cushion 20 is also fixedly provided with a second protecting cover 23 secured thereto and facing the binding hole 21. The second protective cover 23 is provided with a shaft passing hole 231, and a hole diameter of the shaft passing hole 231 is larger than a hole diameter of the binding hole 21. The eccentric column 30 is integrally formed with two straight bar portions 31*a*, 31*b*, for example, an upper half straight bar portion 31*a* and a lower half straight bar portion 31*b*, and a bending portion 32. The two straight bar portions 31*a*, 31*b* are connected by the bending portion 32 but are not located on a common axis. Respective end portions, opposite the bending portion 32, of the two straight bar portions 31*a*, 31*b* are each narrowed in pipe diameter and provided with an assembling section 311*a*, 311*b*, and are combined with the base 10 and the cushion 20 through the corresponding assembling section 311*a*, 311*b*. The lower half straight bar portion 31*b* of the eccentric column 30 passes through the shaft passing hole 131 of the first protecting cover 13, and then is connected to the base bearing members 12 inside the combination hole 11 through the assembling section 311*b* at the end portion of the lower half straight bar portion 31*b*. The base bearing members 12 and the assembling section 311*b* of the lower half part of the eccentric column 30 are protected by the first protecting cover 13, which prevents dirt from falling into the base bearing members 12 and contact with the base bearing members 12 in a static or rotating state, to ensure the smooth rotation of the eccentric column 30 on the base 10. The first protecting cover 13 also prevents a user from contacting lubricating oil or being hurt. The other of the straight bar portions, i.e., the upper half straight bar portion 31*a*, of the eccentric column 30 also passes through the shaft passing hole 231 of the second protecting cover 23 first, and then is connected to the cushion bearing members 22 inside the binding hole 21 through the assembling section 311*a* of the end portion of the upper half straight bar portion 31*a*. The cushion bearing members 22 and the assembling section 311*a* at the upper half part of the eccentric column 30 are protected by the second protecting cover 23, which prevents dirt from falling into the cushion bearing members 22 and contact with the cushion bearing members 22 in a static or rotating state, to ensure the smooth rotation of the cushion 20 on the eccentric column 30 and prevent a user from contacting lubricating oil or being hurt. Thus, the eccentric column 30 is connected between the base 10 and the cushion 20, and the cushion 20 generates an eccentric rotating effect on the base 10 through the eccentric column 30.

FIGS. 3, 4, 5 and 6 illustrate the practical use state of the structure. The waist twisting exercise machine enables riding by a user on the cushion 20, and supports the weight of the user through the eccentric column 30 and the base 10. The cushion 20 is supported by the eccentric column 30 to be slightly higher than the height of knees of an average adult, so that after the user sits on the cushion, his/her feet naturally droop and extend to land on the ground. The two feet landing on the ground can be taken as the points of force application, which enables the lower part of the body and the waist and abdomen to effectively exert force and in turn smoothly drive the rotating action of the cushion 20. During twisting, the lower half straight bar portion 31*b* of the eccentric column 30 takes the combination hole 11 of the base 10 as the center of a circle, so that the cushion 20 makes a circling action above the base 10. In addition, the binding hole 21 of the cushion 20 is connected to the assembling section 311*a* of the upper half straight bar portion 31*a* of the eccentric column 30 through the cushion bearing members 22, so the cushion 20 also can rotate independently on the eccentric column 30, which effectively reduces the slanting thrust generated by the cushion 20 during twisting, and enables the user to easily complete the rotating and circling action on the cushion 20. Through the rotating and circling action, the user can twist the waist and hips to achieve the purpose of exercising.

By means of the structure of the above-mentioned exemplary embodiments, the following beneficial effects can be obtained: the cushion 20 for waist twisting exercising according to the present utility model is supported by the eccentric column 30, so that the seat height is slightly higher than the height of knees of an average adult, thereby enabling riding in a relatively comfortable and ergonomic posture, and performing exercising movements of rotating and waist twisting by using two feet landing on the ground as points of force application. In addition, the eccentric column 30 is integrally formed by bending processing of a metal pipe column, which not only avoids the formation of seams during assembly or structural weaknesses derived from welding, but also greatly enhances the overall strength of the structure, thereby being conducive to prolonging the service life and safety of the exercise machine.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine", "calculate" and "compute," and variations thereof, as used herein, are used interchangeably and include any type of methodology, process, mathematical operation or technique.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

REFERENCE NUMERALS (The Present Disclosure)

10: Base
11: Combination hole
12: Base Bearing member
13: First Protecting cover
20: Cushion
21: Binding hole
22: Cushion Bearing member
23: Second Protecting cover
30: Eccentric column
31*a*: Upper Half Straight bar portion

Figure 7:
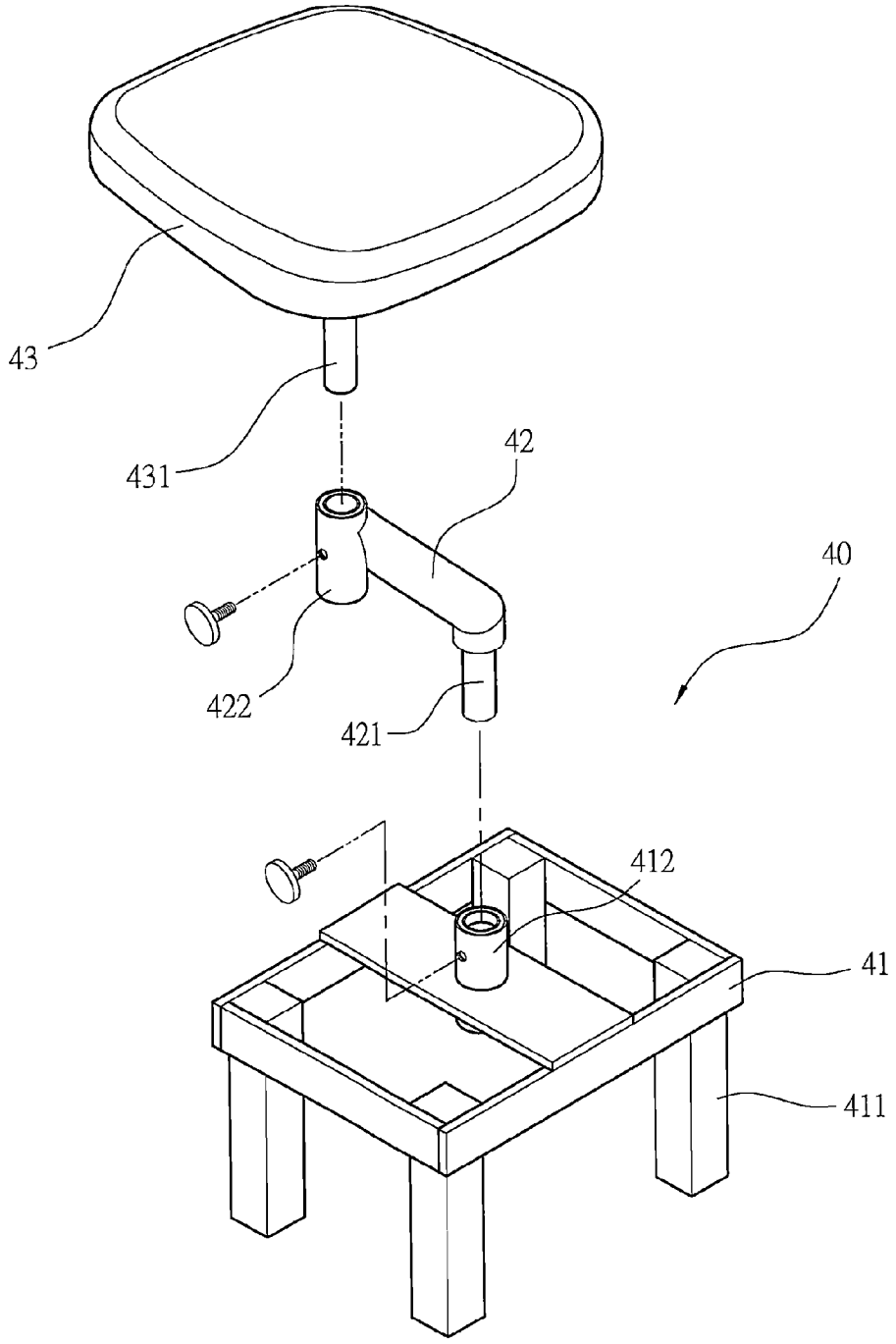
Fig.7 (PRIOR ART)
FIG. 7 shows a schematic diagram of a prior art exercise machine.

31*b*: Lower Half Straight bar portion
32: Bending portion
131: Shaft passing hole
231: Shaft passing hole
311*a*: Assembling section of upper half straight bar portion
311*b*: Assembling section of lower half straight bar portion (Prior Art FIG. 7)
40: Waist exercise machine
41: Base
42: Crank
43: Cushion
411: Short bar
412: Pipe column
421: Shaft column
422: Vertical pipe
431: Plugging column

What is claimed is:

1. An eccentric column structure of a waist twisting exercise machine, comprising:
a base;
a cushion;
an eccentric column assembled between the base and the cushion, wherein:
the eccentric column is integrally formed with a first straight bar portion, a first assembling section having a reduced diameter relative to the first straight bar portion and extending from a first end portion of the first straight bar portion, a second straight bar portion, a second assembling section having a reduced diameter relative to the second straight bar portion and extending from a second end portion of the second straight bar portion, and a bending portion, wherein the first straight bar portion and the second straight bar portion are connected through the bending portion but are not located on a common axis; and
at least one of:
a first protecting cover including a bottom end secured to the base and surrounding the first assembling section, and a top end surrounding the first end portion; or
a second protecting cover including a top end secured to the cushion and surrounding the second assembling section, and a bottom end surrounding the second end portion.

2. The eccentric column structure of a waist twisting exercise machine according to claim 1, wherein:
each of the first end portion and the second end portion are in a spaced apart relationship from the bending portion, and
the eccentric column is connected to the base and the cushion by the first assembling section and the second assembling section.

3. The eccentric column structure of a waist twisting exercise machine according to claim 2, wherein:
the base is provided with a combination hole for accepting the first assembling section, and
at least one base bearing member is disposed inside the combination hole.

4. The eccentric column structure of a waist twisting exercise machine according to claim 3, wherein:
the first protecting cover faces the combination hole, and
the first protecting cover is provided with a shaft passing hole.

5. The eccentric column structure of a waist twisting exercise machine according to claim 4, wherein:
the first straight bar portion passes through the shaft passing hole of the first protecting cover, and the first assembling section is positioned and connected to the at least one base bearing member inside the combination hole, and
the at least one base bearing member and the first assembling section are protected by the first protecting cover.

6. The eccentric column structure of a waist twisting exercise machine according to claim 3, wherein:
the combination hole of the base is located at the center of the base.

7. The eccentric column structure of a waist twisting exercise machine according to claim 3, wherein:
the at least one base bearing member includes two base bearing members disposed inside the combination hole.

8. The eccentric column structure of a waist twisting exercise machine according to claim 2, wherein:
a bottom of the cushion is provided with a binding hole for accepting the second assembling section, and
at least one cushion bearing member is disposed inside the binding hole.

9. The eccentric column structure of a waist twisting exercise machine according to claim 8, wherein:
the cushion is fixedly provided with the second protecting cover facing the binding hole, and
the second protecting cover is provided with a shaft passing hole.

10. The eccentric column structure of a waist twisting exercise machine according to claim 9, wherein:
the second straight bar portion passes through the shaft passing hole of the second protecting cover, and the second assembling section is positioned and connected to the at least one cushion bearing member inside the binding hole, and
the at least one cushion bearing member and the second assembling section are protected by the second protecting cover.

11. The eccentric column structure of a waist twisting exercise machine according to claim 8, wherein:
the at least one cushion bearing member includes two cushion bearing members disposed inside the binding hole of the cushion.

12. The eccentric column structure of a waist twisting exercise machine according to claim 1, wherein:
the cushion is configured to eccentrically rotate above the base, through the eccentric column.

13. The eccentric column structure of a waist twisting exercise machine according to claim 1, wherein:
the cushion is configured to rotate with respect to the eccentric column.

14. An eccentric column structure of a waist twisting exercise machine, comprising:
a base;
a cushion;
an eccentric column assembled between the base and the cushion, wherein:
the eccentric column is integrally formed with a first straight bar portion, a second straight bar portion, and a bending portion, wherein the first straight bar portion and the second straight bar portion are connected through the bending portion but are not located on a common axis,
the first straight bar portion includes a first assembling section extending from a first end portion of the first straight bar portion and the second straight bar portion includes a second assembling section extending from a second end portion of the second straight bar portion, wherein each of the first assembling section and the second assembling section are in a spaced apart relationship from the bending portion and narrowed in pipe diameter relative to the respective first and second end portions, the eccentric column is connected to the base and the cushion by the first assembling section and the second assembling section, and the cushion is configured to eccentrically rotate above the base, through the eccentric column; and at least one of:

a first protecting cover secured to the base and surrounding the first end portion and the first assembling section; or a second protecting cover secured to the cushion and surrounding the second end portion and the second assembling section.

15. The eccentric column structure of a waist twisting exercise machine according to claim 1, wherein:

the base is provided with a combination hole for accepting the first assembling section, at least one base bearing member is disposed inside the combination hole, the first protecting cover facing the combination hole, the first protecting cover is provided with a shaft passing hole, a bottom of the cushion is provided with a binding hole for accepting the second assembling section, at least one cushion bearing member is disposed inside the binding hole, the cushion is fixedly provided with the second protecting cover facing the binding hole, and the second protecting cover is provided with a shaft passing hole.

16. The eccentric column structure of a waist twisting exercise machine according to claim 2, wherein:

the combination hole of the base is located at the center of the base, the first straight bar portion passes through the shaft passing hole of the first protecting cover, and the first assembling section is positioned and connected to the at least one base bearing member inside the combination hole, and the at least one base bearing member and the first assembling section are protected by the first protecting cover.

17. The eccentric column structure of a waist twisting exercise machine according to claim 15, wherein:

the at least one cushion bearing member includes two cushion bearing members disposed inside the binding hole of the cushion, the second straight bar portion passes through the shaft passing hole of the second protecting cover, and the second assembling section is positioned and connected to the two cushion bearing members inside the binding hole, and the two cushion bearing members and the second assembling section are protected by the second protecting cover.

18. The eccentric column structure of a waist twisting exercise machine according to claim 14, wherein:

the cushion is configured to rotate with respect to the eccentric column.

19. An eccentric column structure of a waist twisting exercise machine, comprising:

a base;

a cushion;

an eccentric column assembled between the base and the cushion, wherein the eccentric column is integrally formed with a first straight bar portion, a second straight bar portion, and a bending portion, wherein the first straight bar portion and the second straight bar portion are connected through the bending portion but are not located on a common axis, the eccentric column is pivotally connected to the base and the cushion, wherein the cushion is configured to eccentrically rotate above the base, through the eccentric column, and the cushion is configured to independently rotate relative to the eccentric column;

the eccentric column further including:

a first assembling section having a reduced diameter relative to the first straight bar portion and being integrally formed with a first end portion of the first straight bar portion at a tapered first junction; and a second assembling section having a reduced diameter relative to the second straight bar portion and being integrally formed with a second end portion of the first straight bar portion at a tapered second junction; and at least one of:

a first protecting cover secured to the base and surrounding the tapered first junction; or a second protecting cover secured to the cushion and surrounding the tapered second junction.

* * * * *